United States Patent [19]

Watanabe et al.

[11] Patent Number: 4,842,490

[45] Date of Patent: Jun. 27, 1989

[54] VARIABLE DISPLACEMENT VANE COMPRESSOR

[75] Inventors: Yasushi Watanabe; Shinichi Suzuki; Masahiro Kawaguchi; Tatsuya Naki, all of Kariya, Japan

[73] Assignee: Kabushiki Kaisha Toyoda Jidoshokki Seisakusho, Aichi, Japan

[21] Appl. No.: 176,872

[22] Filed: Apr. 4, 1988

[30] Foreign Application Priority Data

Apr. 16, 1987 [JP] Japan ..... 62-094867

[51] Int. Cl.[4] ..... F04B 49/02; F04C 29/08

[52] U.S. Cl. ..... 417/295; 417/310

[58] Field of Search ..... 417/295, 310, 440; 418/268

[56] References Cited

U.S. PATENT DOCUMENTS 4,653,991 3/1987 Takeo et al. ..... 417/268

4,726,740 2/1988 Suzuki et al. ..... 417/295

FOREIGN PATENT DOCUMENTS 49189 3/1986 Japan ..... 417/440

*Primary Examiner*—William L. Freeh

*Attorney, Agent, or Firm*—Burgess, Ryan & Wayne

[57] ABSTRACT

A variable displacement vane compressor for an air conditioning system used in an automobile has a cylinder assembly having a bore in which a rotor (7) is received to form at least one crescent chamber (R1, R2) between the rotor (7) and the bore. The cooling capacity is adjusted in accordance with a cooling load of the air conditioning system by displacement of an annular plate member (21) for controlling the amount of refrigerant introduced into a crescent chamber (R1, R2). The annular plate member (7) is driven by a driving units (25, 25*a*, 26, 27, 28, S1, S2) in which a dynamic pressure balance between a first compartment (S1) to which a refrigerant gas under a discharging pressure is introduced, and of a second compartment (S2) to which an oil under a discharging pressure is introduced. A sealing means (35*a*, 36) for preventing the leakage of the refrigerant gas from the high pressure region including the first compartment (S1) to the low pressure region is provided between the annular plate member (21) and a front end wall member (4) and an pressurized oil is supplied to the sealing means (35*a*, 36) to enhance the sealing effect of the sealing means (35*a*, 36).

3 Claims, 4 Drawing Sheets

VARIABLE DISPLACEMENT VANE COMPRESSOR

BACKGROUND OF THE INVENTION

1. Field of the Invention

The present invention relates to a rotary vane compressor for an air conditioning system used in a vehicle such as an automobile, and more particularly, it relates to a variable displacement vane compressor which comprises a cylinder assembly including a cylindrical body having a bore and opposed end wall members secured to opposed ends of the cylindrical body, respectively, for closing the open ends of the bore, and a rotor disposed within the bore for rotation so as to form at least one crescent chamber between the rotor and the bore of the cylindrical assembly for receiving a refrigerant, the rotor having at least one vane which is extendably fitted in the rotor so that the free end of the vane is in contact with the circumferential inner wall surface of the bore during the rotation of the rotor, whereby, when the vane passes through the crescent chamber, the refrigerant introduced into the crescent chamber is adjusted in response to a change of a cooling load at the air conditioning system.

2. Description of the Related Arts

Conventionally, a variable displacement vane compressor of the above type is driven by an engine of the automobile, and the room temperature of the automobile is adjustable to a temperature at which a driver and passengers feel comfortable under ambient conditions. When a cooling load of the air conditioning system becomes high, the compressor must work at the maximum cooling capacity thereof, whereas when the cooling load becomes lower, the compressor preferably works at a lower cooling capacity. When the room temperature once reaches a comfortable temperature, the compressor preferably works at the minimum cooling capacity at which a comfortable temperature can be maintained.

U.S. patent application Ser. No. 902,311 (corresponding to Japanese Unexamined Patent Publication No. 60-193328) filed by the same applicant discloses an improvement of a variable displacement vane compressor of the above type, wherein a compression mode carried out by the vane is adjustable in response to a pressure change of the refrigerant within a suction chamber of the compressor, which is connected to an evaporator of the air conditioning system, whereby an amount of compressed refrigerant discharged from the compressor into the air conditioning system can be varied in response to a cooling load of the air conditioning system. Namely, this compressor comprises an annular plate member rotatably disposed between one of the end wall members of the cylinder assembly and the cylindrical body thereof. The annular plate member has an arcuate slot extending in the rotational direction of the vane and opening to the crescent chamber. The vane passes through the crescent chamber in such a manner that the vane divides the crescent chamber into a front and a rear section, with a volume of the front section being gradually decreased while a volume of the rear section is gradually increased. While the vane advances along the arcuate slot of the annular plate member, a part of the refrigerant received in the front section is allowed to escape into the rear section through the arcuate slot, and thus the compression mode starts just after the vane has passed through the arcuate slot of the annular plate member. With this arrangement, it is possible to adjust the compression mode by moving the annular plate member in the rotational direction of the vane in response to a pressure change of the refrigerant within the suction room of the compressor.

This movement of the annular plate member is caused by a spool member slidably accommodated in a cylindrical bore. The spool member divides the bore into two compartments, one of which (a first compartment) is always communicated with a discharging chamber into which the compressed refrigerant is discharged from the crescent chamber, and the other (a second compartment) receives a compression spring to bias the spool toward the first compartment and is communicated with a reservoir for lubricant oil pressurized to a pressure corresponding to that of the discharged refrigerant. The introduction of the oil into the second compartment is controlled by a check valve arranged midway in an oil path extending from the oil reservoir to the second compartment. The check valve operates in response to a change of the interior pressure of the suction chamber in such a manner that, when this pressure is lowered, the check valve allows a larger amount of the oil to flow into the second compartment and, conversely, when the pressure becomes higher, throttles the passage to limit the amount of the oil. The spool is displaced in the bore until a dynamic balance of the interior pressure between both compartments is attained, whereby the annular plate member is rotatably displaced in response to the movement of the spool. To obtain a proper displacement of the annular plate member, the interior pressure of the first compartment must be correctly maintained at a level corresponding to the interior pressure of the discharge chamber. The refrigerant (gas) filled in the second compartment, however, tends to leak therefrom to a lower pressure region in the compressor, mainly through an evitable micro-gap between a surface of the annular plate member and the associated surface of the end wall member in contact therewith. Thus, the dynamic balance of pressure between both the compartments is attained when the spool is displaced more to the first compartment side from the proper position.

SUMMARY OF THE INVENTION

Accordingly, an object of the present invention is to provide an improved variable displacement vane compressor wherein a cooling capacity is properly controlled in accordance with a pressure of refrigerant gas presented in a suction chamber of a compressor.

Another object of the present invention is to provide an improved variable displacement vane compressor of the above-mentioned type wherein an effective sealing means is provided between an annular plate member for preventing the leakage of the refrigerant from a high pressure region to a low pressure region.

In accordance with the present invention, there is provided a variable displacement vane compressor for an air conditioning system used in a vehicle such as an automobile, comprising: a cylinder assembly including a cylindrical body having a bore and opposed end wall members secured to opposed ends of the cylindrical body, respectively, for closing open ends of the bore; a rotor disposed within the bore for rotation so as to form at least one crescent chamber between the rotor and the bore of the cylindrical assembly for receiving a refrigerant, the rotor having at least one vane which is extendably fitted in the rotor so that the free end of the vane is in contact with the circumferential inner wall surface of the bore during the rotation of the rotor whereby, when the vane has passed through the crescent chamber, the refrigerant received therein can be compressed. The cylinder assembly is provided with a discharge chamber for receiving the refrigerant discharged from the crescent chamber after compression therein and a suction chamber for receiving the refrigerant returned from the air conditioning system before being introduced into the crescent chamber. An annular plate member is disposed between one of the end wall members and associated end portion of the cylindrical body in such a manner that one surface of the annular plate member is closely in contact with the associated surface of the end wall member and rotatingly displaceable between first and second positions while sliding on the associated surface of the end wall member; the annular plate member having an arcuate slot for adjusting the maximum volume of the crescent chamber when the effective compression mode begins to compress the refrigerant received therein, which varies in accordance with the displacement of the annular plate member between the first and second positions. A driving means is provided for displacing the annular plate member between the first and second positions in response to a change of a cooling load of the air conditioning system, comprising a hydraulic actuator including a spool member movably received within a cylindrical bore so as to divide the cylindrical bore into first and second compartments, the first compartment being communicated with the discharge chamber filled with the refrigerant discharged from the crescent chamber and the second compartment being communicated with a reservoir for the lubricant oil under pressure corresponding to a pressure of the refrigerant discharged from the crescent chamber, the spool being connected to the annular plate member through a pin fixed on the annular plate member, whereby the movement of the spool transfers to the annular plate member to cause the movement thereof between the first and second positions.

A valve means is provided for controlling an amount of oil introduced through an oil passage from the reservoir to the second compartment; a valve actuator for operating the valve means comprising a piston member having one end exposed to a pressure of the refrigerant returned from the air conditioning system to the suction chamber so that the valve means is actuated in response to a change of the refrigerant pressure. A sealing means is provided for a fluid-tight separation of the high and low pressure regions in the compressor, the sealing means being disposed between the surfaces of the annular plate member and the end wall member in contact with each other, and an oil supply means is provided for introducing an oil from the oil reservoir, at a pressure corresponding to that of the refrigerant discharged from the crescent chamber, to the sealing means.

The sealing means preferably may be a sealing ring accommodated within an annular groove recessed on the associated surface of the end wall member in contact with the annular plate member. Further, the sealing means may be preferably provided so as to encircle the pin fixed on the annular plate member for connecting the spool with the annular plate member.

BRIEF DESCRIPTION OF THE DRAWINGS

These and other objects of the present invention will be better understood from the following description with reference to the accompanying drawings illustrating the preferable embodiments according to the present invention, in which.

DESCRIPTION OF THE PREFERRED EMBODIMENTS

Figure 1:
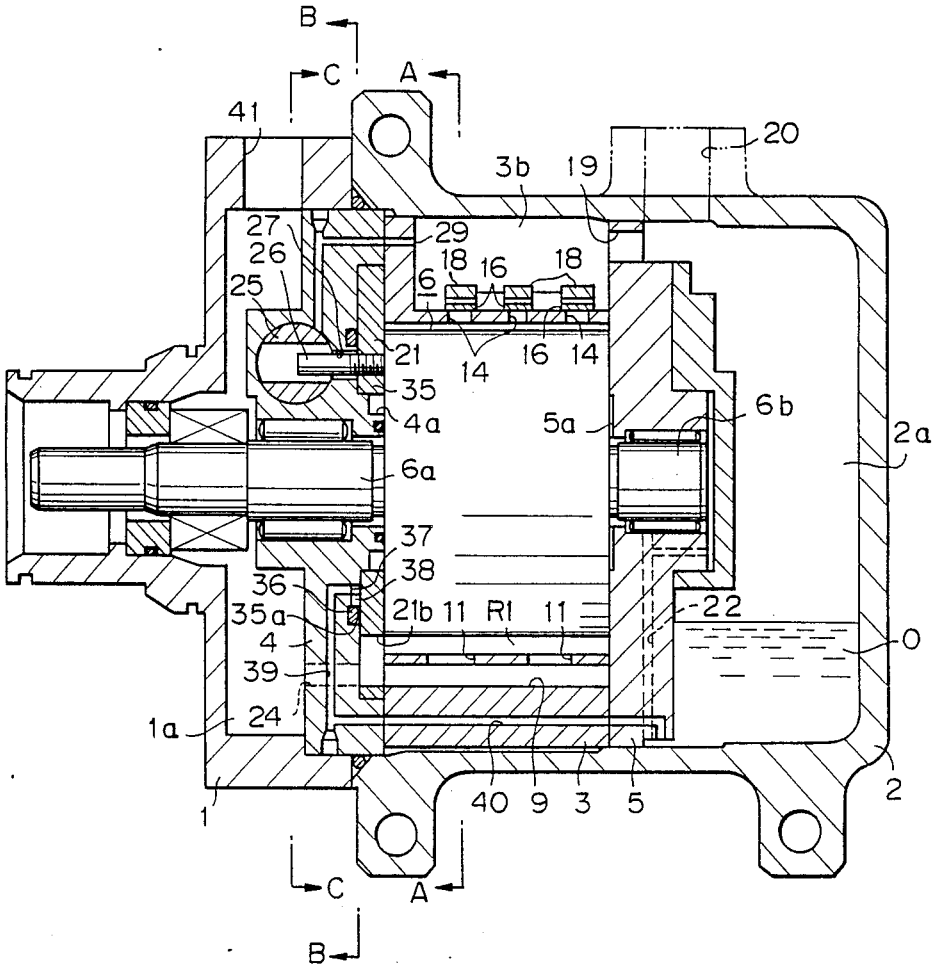
FIG. 1 is a longitudinal sectional view of a variable displacement vane compressor according to the present invention.

With reference to FIG. 1, a variable displacement vane compressor according to the present invention comprises a pair of front and rear housings 1 and 2 rigidly assembled to each other by a suitable clamping means such as bolts and nuts (not shown). Within the inner space of the assembled housings 1 and 2 is installed a cylinder assembly comprising a cylindrical body 3 having a bore in the shape of an elliptic cylinder and front and rear wall members 4 and 5 secured to the opposed ends of the cylindrical body 3, respectively, for closing the bore at the opening ends thereof. A cylindrical rotor 6 is accommodated within the bore for rotation in the arrowed direction shown in FIG. 2, with shaft portions 6*a*, 6*b* projected from the opposite end surfaces of the rotor 6 being held by bearings arranged on the end wall members 4 and 5, respectively. The rotor 6 is provided with a plurality of (four in the illustrated embodiment) vanes 7 which are extendably fitted therein so that the free ends of the vanes 7 are in contact with the circumferential inner surface of the bore during rotation of the rotor 6, while the opposite sides of the vane are in close contact with the inner surfaces of the front and rear end wall members 4 and 5. More particularly, as best seen in FIG. 2, the rotor 6 is provided with four slits 8 formed therein and circumferentially spaced at regular intervals, and the vanes 7 are slidably inserted into the respective slits 8.

As seen from FIG. 2, each of the slits 8 has an enlarged portion at the bottom thereof which forms a lubricant oil passage through which an lubricant oil is supplied thereto from an oil reservoir of an oil separating chamber 2*a* described hereinafter. That is, the slit 8 communicates with the oil reservoir of the oil separating chamber 2*a* formed in the rear housing 2 through an annular recess 5*a* formed on the rear end wall member 5, a bearing portion provided in the shaft 6*b*, and a passage 22 formed through the rear end wall member 5. Since the lubricant oil is pressurized by the compressed refrigerant within the oil separating chamber 2*a*, the vanes 7 are pushed out of the respective slits 8 due to introduction of the oil into the slit 8. This movement is assisted by a centrifugal force acting on the vane caused by rotation of the rotor 6. Therefore, the contact between the free end of the vane 7 and the inner surface of the bore of the cylindrical body 3 can be constantly maintained, so that the inner space of the bore is divided into a plurality of crescent chambers R1 and R2 by the respective vanes 7. An annular recess 4*a* is formed also on the inner surface of the front end wall member 4 at a position coinciding with the bottom of the slits 8, whereby the oil is supplied to the slit 8 through the annular recess 4a.

Figure 2:
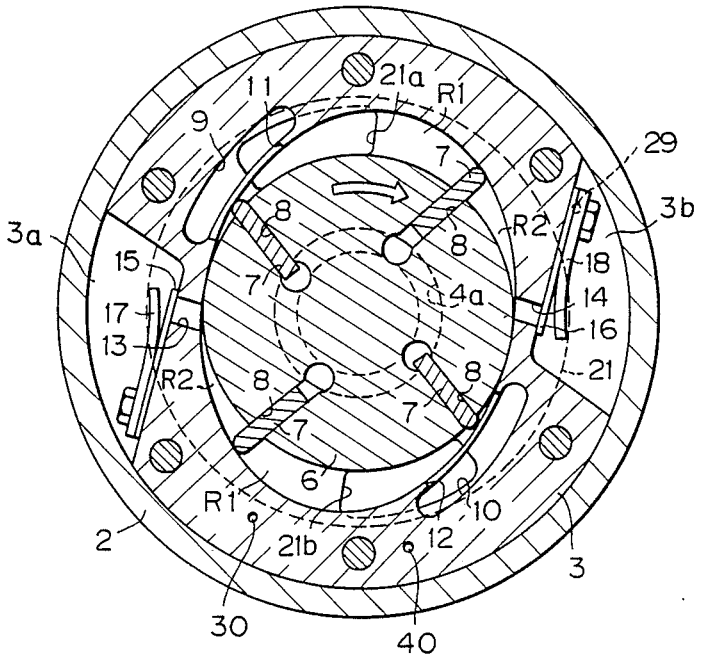
FIG. 2 is a cross section taken along line A—A of FIG. 1.

As seen from FIGS. 1 and 2, the cylindrical body 3 is provided with a pair of suction slots 9 and 10 extending in the axial direction of the cylindrical body 3. Suction ports 11 and 12 communicating with the suction slots 9 and 10, respectively, are provided symmetrically to each other relative to the axis of the cylindrical body 3 and open to the bore of the cylindrical body 3. In the vicinity of the suction slots 9 and 10, along the circumference of the cylindrical body 3, a pair of discharge chambers 3a and 3b are formed symmetrically to each other and discharge ports 13 and 14 open to the discharge chambers 3a, 3b, respectively. The discharge ports 13 and 14 are operatively closed by reed valves 15 and 16, respectively, disposed inside of the discharge chambers 3a and 3b. The reed valves 15, 16 are formed as a resilient blade and the displacement thereof is limited by stop plates 17, 18, respectively. The interiors of both discharge chambers 3a and 3b communicate with the oil separating chamber 2a via ports 19 (only one shown in FIG. 1) provided in the rear end wall member 5. The interior of the oil separating chamber 2a is communicated with the air conditioning system through an exit port 20.

Figure 4:
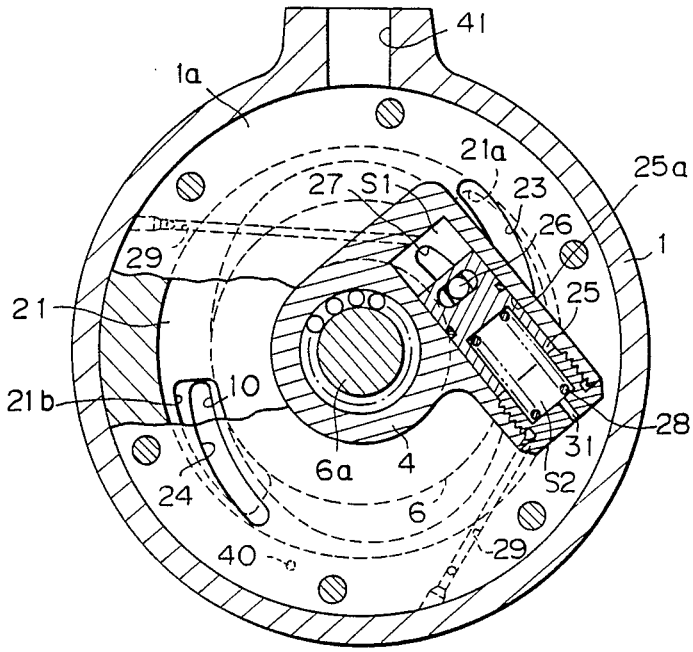
FIG. 4 is a cross section taken along line C—C of FIG. 1.

An annular plate member 21 is arranged between the front end wall member 4 and the rotor 6. The annular plate member 21 is received in an annular recess 35 formed on the inner surface of the front end wall member 4 and is rotated by a driving mechanism described hereinafter in a reciprocated manner about the shaft portion 6a. Also the annular plate member 21 has a pair of arcuate slots 21a and 21b disposed symmetrically to each other relative to the axis of the cylindrical body 3. The arcuate slots 21a, 21b are able to communicate both with the suction slots 9 and 10 and with the crescent chambers R1 and R2 throughout a range within which the annular plate member can displace about the shaft portion 6a. In this regard, a position of the annular plate member 21 at which the arcuate slots 21a and 21b are closest to the suction slots 9 and 10 is referred to as a first position, and a position at which the arcuate slots 21a and 21b are farthest from the suction slots 9 and 10 is referred to as a second position hereinafter. As seen in FIG. 4, a pair of inlet ports 23 and 24 are provided on the front end wall member 4, corresponding to the suction slots 9 and 10. The suction chamber 1a formed in the front housing 1, which communicates with the air conditioning system through an inlet 41, is connected both to the suction slots 9 and 10 and to the crescent chambers R1 and R2 via the inlet ports 23 and 24 and the arcuate slots 21a and 21b.

A mechanism for driving the annular plate member 21 will be explained with reference to FIGS. 1 and 4. A spool 25 is accommodated in a bore 25a formed in the front end wall member 4 adjacent to the annular plate member 21. The spool 25 is slidably movable in the bore 25a in the axial direction thereof, i.e., substantially along the tangent of the annular plate member 21. A pin 26 fixed on the annular plate member 21 is loosely inserted in an aperture formed in the spool 25 through an arcuate hole 27 provided on the front end wall member 4. The bore 25a is divided by the spool 25 into a first compartment S1 and a second compartment S2. The spool 25 is biased toward the first compartment S1 side by a compression spring 28 received within the second compartment S2. As seen from FIGS. 1 and 4, the first compartment S1 communicates with one of the discharge pools 3b through a passage 29, whereas, as seen from FIGS. 1 and 5, the second compartment S2 communicates with the oil reservoir in the oil separating chamber 2a through a passage 30. The second compartment S2 also communicates with the suction chamber 1a through an orifice 31.

Figure 5:
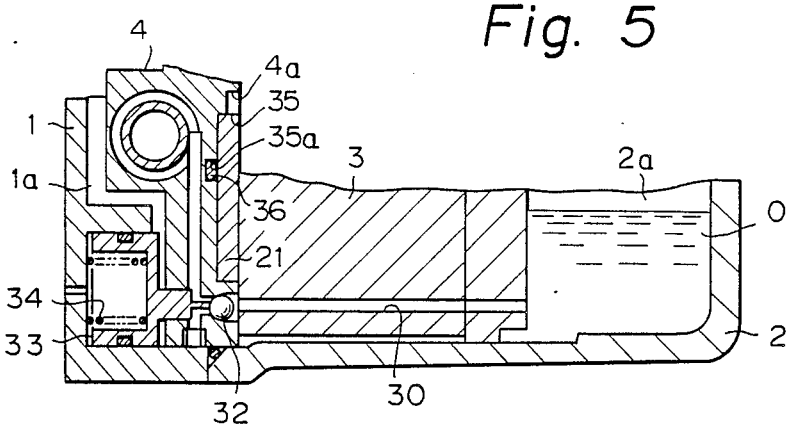
FIG. 5 is a partial sectional view illustrating a valve actuator used in the embodiment.

As seen from FIG. 5, a valve operating mechanism consisting of a check valve 32 and a piston 33 exposed in the interior of the suction chamber 1a is provided. A compression spring 34 is provided midway in the piston 33. A sum of the force derived from the compression spring 34 and the atmospheric pressure is applied on one end surface of the piston 33 so as to push the valve 32 to open the passage 30, whereas a force derived from the interior pressure of the suction chamber 1a (suction pressure) and the interior pressure of the oil separating chamber 2a (discharging pressure) are applied on the other end of the piston 33 in the reverse direction to push the valve 32 to close the passage 30. According to this mechanism, a controlled throttling of the passage 30 can be obtained by a dynamic balance between the opposed pressures applied on the respective ends of the piston 33.

Figure 3:
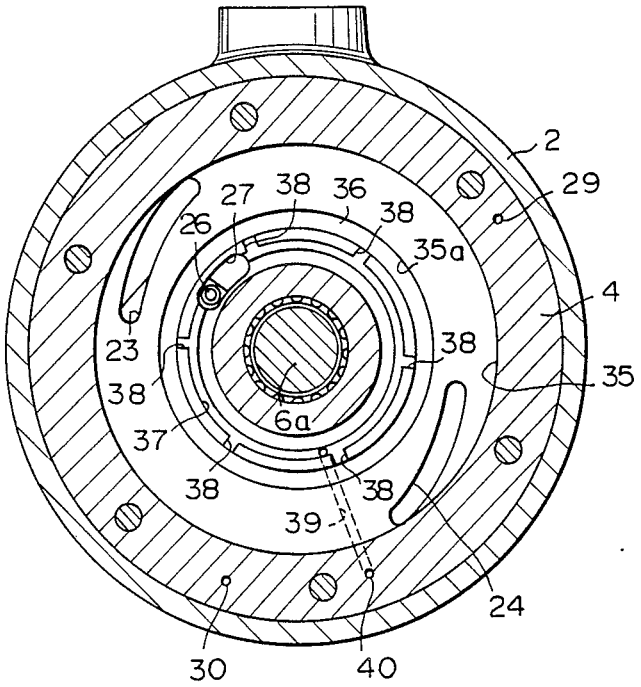
FIG. 3 is a cross section taken along line B—B of FIG. 1.

As seen from FIG. 3, on the bottom of the recess 35 formed in the front end wall member 4 for accommodation of the annular plate member 21 is formed an annular groove 35a encircling the shaft portion 6a and the arcuate hole 27. A sealing ring 36 is inserted in the groove 35a to constitute a sealing means fluid-tightly separating a high pressure region from a low pressure region. In the front end wall member 4 is formed an intermediate passage 37 which communicates with the groove 35a through a plurality of channels 38. The intermediate passage 37 communicates with the oil reservoir of the oil separating chamber 2a through passages 39 and 40 formed in the front end wall member 4 and in the cylindrical body 3, so that the oil is supplied from the oil reservoir to the groove 35a. The functions of the sealing means will be described later in more detail.

At the initial stage of the operation of the compressor, the interior pressures of the suction chamber 1a and the discharging room 3a or 3b are equal. Soon after the operation has started, the passage 30 is communicated with the second compartment S2 by the action of the check valve 32 because the interior pressure of the suction chamber 1a is low. The spool 25 occupies a position at which the end of the spool 25 is in contact with the inner end of the first compartment S1, because of a selected spring modulus of the spring 28. Under these conditions, the annular plate member 21 occupies the first position described before at which the arcuate slots 21a and 21b are farther from the inlet ports 23 and 24 and the suction slots 9 and 10 in the rotational direction of the rotor 6. The refrigerant gas in the suction chamber 1a is introduced into the crescent chamber R1, which is now in the expansion mode. This crescent chamber R1 is gradually shifted to the compression mode as the rotor 6 rotates. During a certain period after the crescent chamber R1 has been shifted to the compression mode, the arcuate slots 21a and 21b are still in communication with the crescent chamber, whereby a substantial compression of the refrigerant gas is inhibited for this period. In other words, the initial volume of the crescent chamber R1 when completely closed is limited to the minimum level so that the compressor works at the minimum cooling capacity. Thus, the load of an automobile engine driving the compressor is reduced at the initial stage of the operation.

As a result of a continuous operation of the compressor under the minimum cooling capacity, a dynamic pressure balance on the check valve 32 changes to move the same to close the passage 30. Thereby the supply of the lubricant oil to the second compartment S2 through the passage 30 is inhibited, and the spool 25 is displaced toward the second compartment side so that a new dynamic pressure balance is established between the first compartment S1 communicating with the discharge chamber 3*b* via the passage 29 and the second compartment S2 from which the oil filled therein gradually leaks to the suction chamber 1*a* via the orifice 31, as illustrated in FIG. 4. According to this displacement of the spool 25, the annular plate member 21 rotates clockwise in the drawing to occupy the second position so that the substantial parts of the arcuate slots 21*a*, 21*b* are in alignment with the inlet ports 23 and 24 and the suction passages 9 and 10. As a result, the communication between the arcuate slots 21*a* and 21*b* and the crescent chamber R1 is inhibited immediately after the crescent chamber R1 has shifted from the expansion mode to the compression mode, whereby the refrigerant gas in the crescent chamber R1 is immediately compressed. In other words, the volume of the crescent chamber R1 when completely closed is increased to the maximum level so that the compressor can work at the maximum cooling capacity.

As the room temperature approaches the predetermined desirable value according to this operation under the maximum cooling capacity, the interior pressure of the suction chamber 1*a* is lowered by a decrease in the cooling load, and the check valve 32 opens the passage 30 to a proper extent in response thereto. This causes the lubricant oil in the oil reservoir of the oil separating chamber 2*a* to be introduced into the second compartment S2, and the oil thus introduced puts pressure on the end of the spool 25. Since an amount of oil flowing in the second compartment S2 is more than that leaked therefrom through the orifice 31, the spool 25 is displaced toward the first compartment S1 side until another dynamic pressure balance has been established, and drives the annular plate member 21 toward an intermediate position between the first and second positions described before, at which the cooling capacity of the compressor is properly lowered.

As stated above, the cooling capacity of the compressor can be regulated by controlling a dynamic balance between the interior pressures of the first and second compartments S1 and S2, in response to a change of the interior pressure of the suction chamber 1*a*, which pressure substantially corresponds to the temperature of a room to be air conditioned.

Note, the high pressure refrigerant gas filled in the first compartment S1 is liable to leak therefrom to a low pressure region such as the arcuate slots 21*a* and 21*b* through an inevitable micro-gap between surfaces of the annular plate member 21 and of the front end wall member 4 in close contact with each other. This leakage of the refrigerant gas causes a decrease in the interior pressure of the first compartment S1, and displaces the spool 25 excessively to the first compartment side. Also the annular plate member 21 is excessively rotated, resulting in an undesirable lowering of the cooling capacity of the compressor. To eliminate these drawbacks, according to the present invention, the lubricant oil having a pressure corresponding to the interior passage of the discharge chamber 3*a* is directly supplied to the aforesaid sealing means comprising the groove 35*a* and the sealing ring 36 accommodated therein through the passages 40 and 39, the intermediate passage 37, and the channel 38. Due to the effect of this oil seal, the sealing means can effectively prevent the leakage of the high pressure refrigerant gas from the first compartment S1. In this connection, the sealing ring 36 and the groove 35*a* is preferably arranged so as to encircle the pin 26 inserted in the spool 25, because the leakage of the refrigerant gas from the first compartment S1 is liable to occur in this area.

It should be noted that the present invention is not limited to the above embodiment but includes many modifications thereof. For example, the annular recess 4*a* formed on the front end wall member 4 may be communicated with the groove 35*a* so that the high pressure oil is supplied to the sealing ring 36 through the passage 22, the annular recess 5*a* formed on the rear end wall member 5, the bottom of the slit 8, and the annular recess 4*a*.

We claim:

1. A variable displacement vane compressor for an air conditioning system used in a vehicle such as an automobile, comprising:

a cylinder assembly including a cylindrical body having a bore and opposed end wall members secured to opposed ends of the cylindrical body, respectively, for closing open ends of the bore;

a rotor disposed within the bore for rotation so as to form at least one crescent chamber between the rotor and the bore of the cylindrical assembly for receiving a refrigerant, the rotor having at least one vane which is extendably fitted in the rotor so that a free end of the vane is in contact with the circumferential inner wall surface of the bore during the rotation of the rotor whereby, when the vane has passed through the crescent chamber, the refrigerant received therein can be compressed;

the cylinder assembly having a discharge chamber for receiving the refrigerant discharged from the crescent chamber after compression therein and a suction chamber for receiving the refrigerant returned from the air conditioning system before being introduced into the crescent chamber;

an annular plate member disposed between one of the end wall members and associated end portion of the cylindrical body in such a manner that one surface of the annular plate member is in close contact with the associated surface of the end wall member and is rotatingly displaceable between first and second positions while sliding on the associated surface of the end wall member;

the annular plate member having an arcuate slot for adjusting the maximum volume of the crescent chamber when the effective compression mode begins to compress the refrigerant received therein by the throttling effect of the slot, which varies in accordance with the displacement of the annular plate member between the first and second positions;

a driving means for displacing the annular plate member between the first and second positions in response to a change of a cooling load of the air conditioning system, comprising a hydraulic actuator including a spool member movably received within a cylindrical bore so as to divide the cylindrical bore into first and second compartments, the first compartment being communicated with the dicharging room filled with the refrigerant discharged from the crescent chamber and the second compartment being communicated with a reservoir for the lubricant oil under pressure corresponding to a pressure of the refrigerant discharged from the crescent chamber, the spool being connected to the annular plate member through a pin fixed on the annular plate member, whereby the movement of the spool is transferred to the annular plate member to cause a movement thereof between the first and second positions;

a valve means for controlling an amount of oil introduced through an oil passage from the reservoir to the second compartment;

a valve actuator for operating the valve means, comprising a piston member having one end exposed to a pressure of the refrigerant returned from the air conditioning system to the suction chamber so that the valve means is actuated in response to the change of the refrigerant pressure;

a sealing means for fluid-tightly separating high and low pressure regions in the compressor, the sealing means being disposed between the surfaces of the annular plate member and the end wall member which are in contact with each other, the low pressure chamber being located radially inwardly of the seal means; and an oil supplying means for introducing an oil from the oil reservoir, under the pressure corresponding to that of the refrigerant discharge from the crescent chamber, to a low pressure side of the sealing means.

2. A variable displacement vane compressor defined in claim 1, wherein the sealing means comprises a sealing ring accommodated within an annular groove recessed on the associated surface of the end wall member in contact with the annular plate member.

3. A variable displacement vane compressor defined in claim 1 or 2, wherein the sealing means is provided so as to encircle the pin fixed on the annular plate member for connecting the spool with the annular plate member.

* * * * *

UNITED STATES PATENT AND TRADEMARK OFFICE

CERTIFICATE OF CORRECTION

PATENT NO. : 4,842,490

DATED : June 27, 1989

INVENTOR(S) : Yasushi Watanabe, et al

It is certified that error appears in the above-identified patent and that said Letters Patent is hereby corrected as shown below:

On the title page:

Item [75] Inventors: please change "Tatsuya Naki" to --Tatsuya Nakai--.

Signed and Sealed this

Eighth Day of May, 1990

*Attest:*

HARRY F. MANBECK, JR.

*Attesting Officer*

*Commissioner of Patents and Trademarks*